United States Patent [19]

Hoyle et al.

[11] 4,337,939

[45] Jul. 6, 1982

[54] ANKLE EXERCISE DEVICE

[76] Inventors: David C. Hoyle, 5933 Little Pine La.; Sue Kandarian, 170 Cedarwald Ct., both of Rochester, Mich. 48063

[21] Appl. No.: 122,973

[22] Filed: Feb. 20, 1980

[51] Int. Cl.[3] ..... A01B 23/04

[52] U.S. Cl. ..... 272/96; 272/117

[58] Field of Search ..... 272/96, 117, 73; 128/25 B

[56] References Cited

U.S. PATENT DOCUMENTS

| | | | |
|---|---|---|---|
| D. 189,011 | 10/1960 | Berne | 272/96 |
| 2,815,020 | 12/1957 | Barkschat | 128/25 B |
| 2,921,791 | 1/1960 | Berne | 272/117 |
| 3,020,046 | 2/1962 | Hotas | 272/96 |
| 4,186,920 | 2/1980 | Fiore | 272/132 |

FOREIGN PATENT DOCUMENTS

| | | | |
|---|---|---|---|
| 609109 | 9/1948 | United Kingdom | 272/96 |
| 675742 | 7/1952 | United Kingdom | 272/96 |

*Primary Examiner*—Richard J. Johnson

*Attorney, Agent, or Firm*—Krass, Young & Schivley

[57] ABSTRACT

An exercise device which is adapted to provide resistance to ankle flexion about a plurality of spaced axes. The device can be quickly and easily adjusted to allow exercising of the anterior, posterior, medial, and lateral muscles of the ankle and lower leg. When attached to this device, all ankle movement takes place about a single pivot axis, the multidirectional quality being achieved by changing the orientation of the user's foot and ankle to the resistive movement about the pivot axis. A movable foot plate secures the user's foot and ankle in the desired orientation, parallel or perpendicular, to the pivot axis.

5 Claims, 11 Drawing Figures

Fig-1
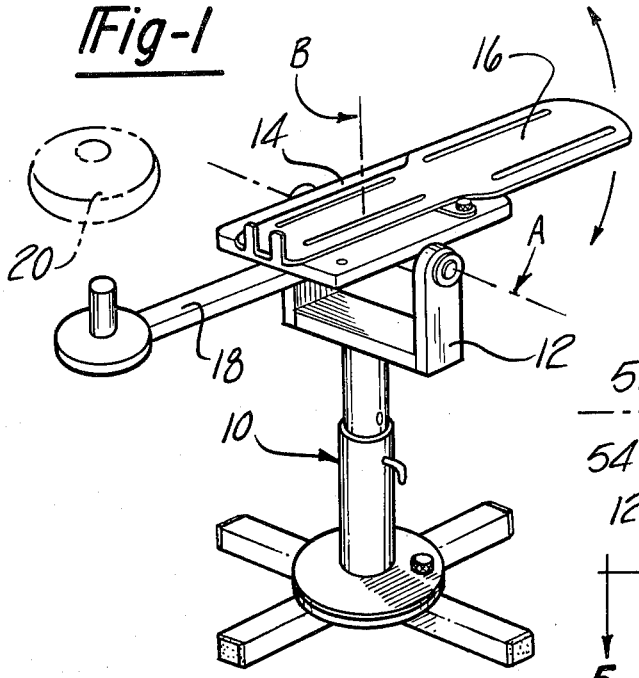
Fig-4
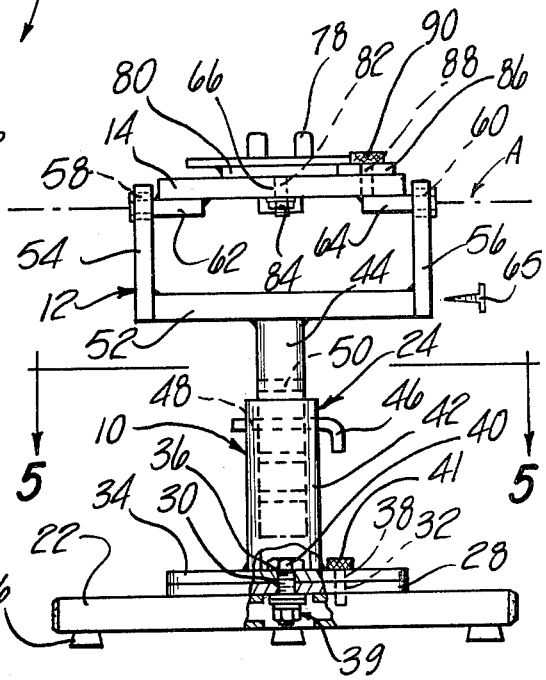
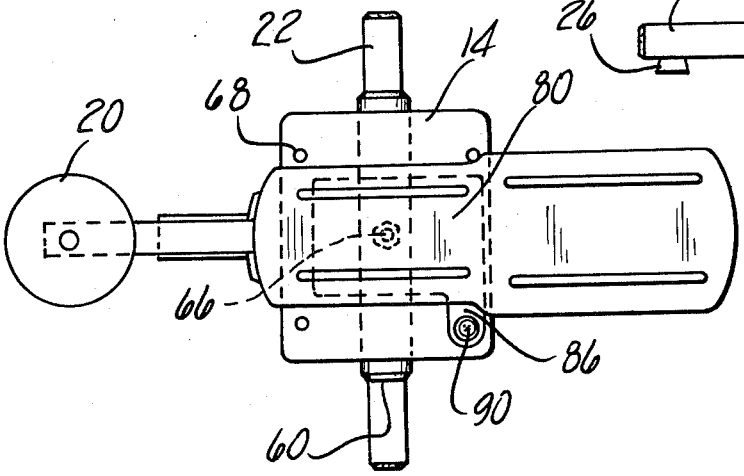
Fig-2
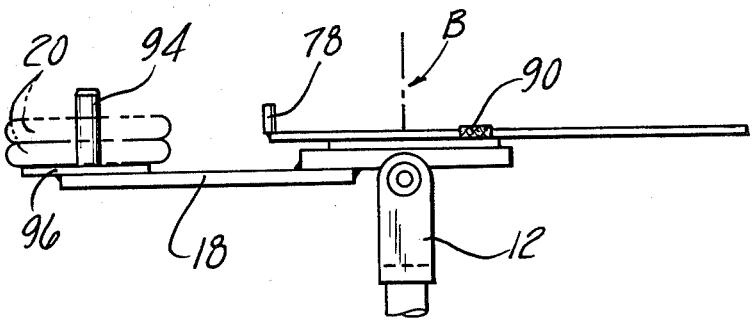
Fig-3

Fig-5
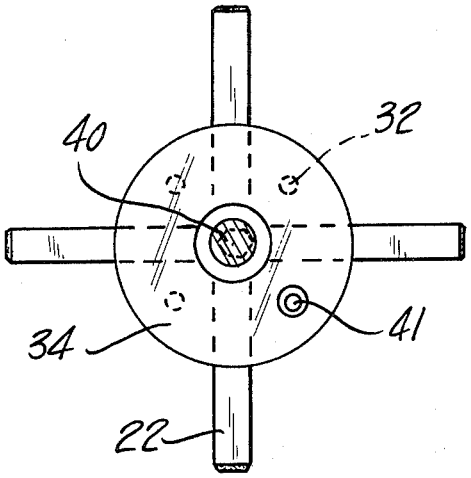
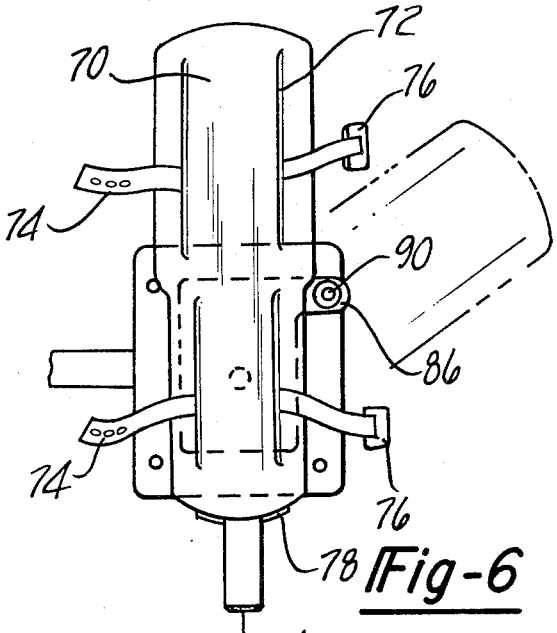
Fig-6
Fig-7
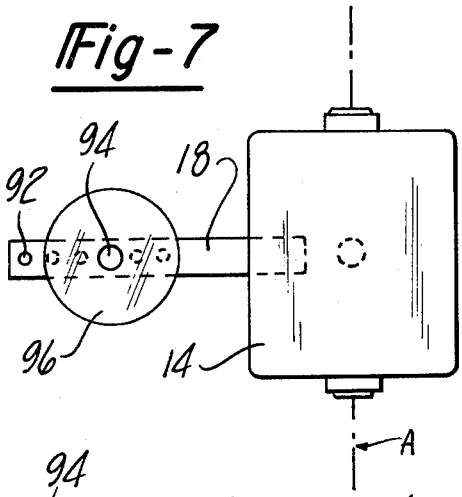
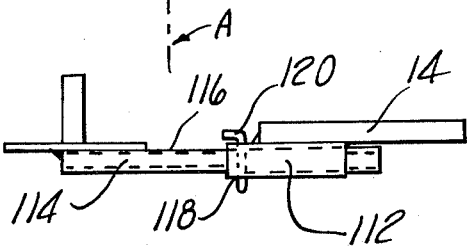
Fig-11
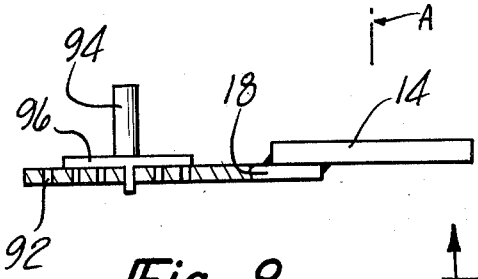
Fig-8
Fig-9
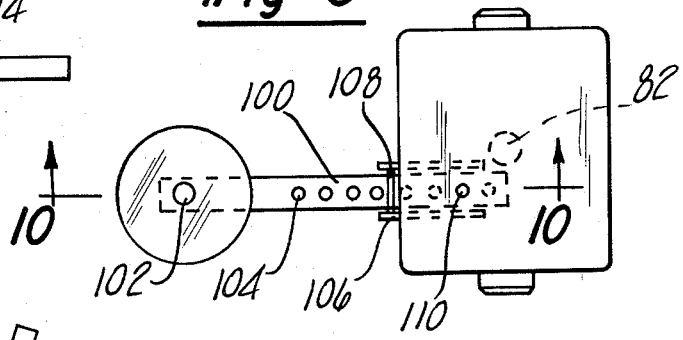
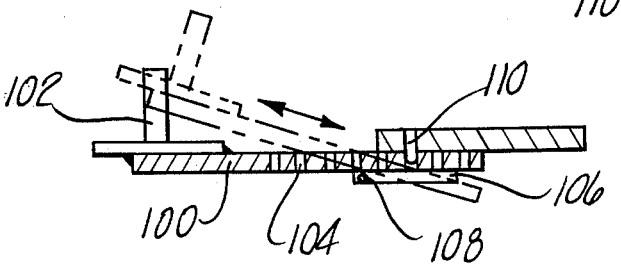
Fig-10

ANKLE EXERCISE DEVICE

INTRODUCTION

This invention relates to weight-loaded exercise devices and particularly to a device for providing weight-loaded exercise for ankles and lower legs.

BACKGROUND

The human ankle comprises a great number of interconnected bones, muscles, ligaments, tendons and cartilage. This complex combination results in a joint capable of flexing in a wide range of directions. The movements are divided into four types: dorsiflexion, toward the position perpendicular to the leg; plantar flexion, toward the position extending away from the leg; inversion, toward the midline of the body; and eversion, away from the midline of the body.

The complexity and wide range of movement required of the ankle combined with the fact that the entire weight of the body is supported by the ankle results in the application of severe stresses. If an ankle is weak the application of a severe stress may cause injury. Injuries are most commonly caused by the ankle being forced to absorb a stress while flexed laterally or medially. Coming down on the side of one's foot while running or jumping is a typical example. The resultant sprained ankle must be immobilized for a period of weeks to heal, during which time the muscles of the lower leg experience atrophy. Therapy consisting of strengthening the lower leg muscles is required to reduce the possibility of reinjury and restore full use of the ankle.

The condition known as weak arches, or flat feet, is often accompanied by inadequate musculature in the lower leg. Weakness is this area makes a person more susceptible to both foot and ankle injuries. Strengthening these muscles increases the support provided by the foot and ankle and thereby increases resistance to injury.

Shin splints is a general term for injuries that result in a tearing of the tendons, muscles or interosseous membrane of the lower leg.

One cause of shin splints may be an imbalance between the calf muscles and anterior muscles. In a conditioning program the calf muscles may become stronger than the anterior muscles which may cause the tearing of the anterior muscles by the calf muscles.

Another possible cause of shin splints may be a weak arch. When the muscles of the foot become weak, the bones may spread resulting in a flattening of the arch. When this happens, the ligaments which secure the tendons of the muscles to the bones of the foot are loosened. This leads to the tendons lifting and pulling away from the bone.

Running on hard surfaces may cause another type of shin splint injury. An impact on the heel bone is transferred to the lower leg, whereupon, the two bones of the lower leg, the tibia and fibula, may be spread apart if the lower leg muscles are weak. This results in a tearing of the intersseous membrane that holds the tibia and fibula together.

All of the above injuries occur when the muscles of the lower leg and/or foot are weak or lack flexibility. An excellent way to prevent injuries such as ankle sprains and shin-splints from occurring as well as the quickest way to re-strengthen the ankle after it has recovered from an injury is to exercise the ankle by applying a resistance to the movement of the foot and ankle in a particular direction and then flexing the muscles of the ankle and lower leg against this. To maintain the muscular balance of the foot all of the muscles should be exercised. A complete series of exercises would include dorsiflexion, plantarflexion, inversion and eversion movements. The exercises should include a range of motion equivalent to that of a healthy ankle. Exercises involving the full range of motion have been shown to enhance flexibility and so further aid in injury prevention.

Doctors, physical therapists and athletic trainers suggest a variety of different exercises to strengthen the lower leg and ankle muscles. Most of these exercises are of an isometric nature, the muscle flexion being resisted by an immovable object or by an opposing muscle group so that the ankle does not move. This absence of motion is desirable when rehabilitating a recently injured ankle which must remain immobile for proper healing, but it is not necessary when trying to strengthen a healthy ankle. Isometric exercises are difficult to perform in that a great amount of mental discipline is required of the exerciser to perform a series of fullstrength muscle contractions which must be maintained for a period of 10 seconds or more. Isometric exercises do not provide the full range of motion that is required to improve flexibility.

Various devices have been designed to resist ankle flexion through a range of motion. However, most of these devices can provide resistance to movement in only one direction or, if they can resist several directions of movement, are cumbersome to use and difficult to adjust to the direction or level of resistance desired. Most prior art devices lack adequate range of motion for enhancing flexibility or stretching exercises.

The present invention is directed to providing an exercise device for strenghtening and rehabilitating the ankle and lower leg that overcomes the problems as set forth above.

SUMMARY OF THE INVENTION

The present invention provides an exercise device that permits a complete series of ankle exercises through a wide range of movement. The device may be quickly and easily adjusted to provide resistance to ankle flexion in any direction. The amount of resistance to ankle flexion may be easily adjusted to any desired level. Whereby, a device is disclosed that allows an ankle to be exercised in all directions, through a wide range of movement and at variable levels of exertion.

These and other objects of the present invention, which will become apparent upon a reading of the following specification and claims, are achieved by constructing an exercise device which allows variation of the orientation of the user's foot relative to the direction in which the resistance acts. The device comprises a rotation resistant element attached to a plate pivotable about a horizontal axis, the moment about this axis is the force against which the ankle is flexed. A foot plate is provided to hold the user's foot on top of the pivot plate, said foot plate is rotatable about a vertical axis until locked in a desired position relative to the horizontal pivot axis. By positioning the user's foot parallel or perpendicular to the horizontal axis of the pivot plate, resistance to lateral, or anterior and posterior flexion may be obtained, respectively.

In the preferred embodiment a cruciform base supports a U-shaped bracket which holds the pivot plate and attached weight arm. Means are present to permit adjustment of the amount of weight on the weight arm and the distance at which it is held from the pivot axis. The foot plate is oblong in shape to match that of an average sized shoe and is disposed on top of the pivot plate being rotatable about its approximate center. A pin is attached to the foot plate and engages one of four holes in the pivot plate to lock the foot plate against rotation during use of the device. Slots are formed along the edges of the foot plate through which pass straps of leather or a similar material. These straps hold the user's foot securely in position on the foot plate.

BRIEF DESCRIPTION OF THE DRAWINGS

FIG. 1 is a perspective view of an embodiment of the present invention.

FIG. 2 is a plan view in the anterior flexion or posterior flexion position of the upper portion of an embodiment of the present invention.

FIG. 3 is a side view of the upper portion of an embodiment of the present invention.

FIG. 4 is a front view partially cut away to show assembly details of an embodiment of the present invention.

FIG. 5 is a plan view of the base portion of an embodiment of the present invention.

FIG. 6 is a plan view of the foot receiving means in the lateral flexion position with phantom lines showing a partial rotation toward the anterior flexion or posterior flexion position of an embodiment of the present invention.

FIG. 7 is a plan view of the weight arm attaching means of an embodiment of the present invention.

FIG. 8 is a side view of the weight arm attaching means of an embodiment of the present invention.

FIG. 9 is a plan view of an alternative weight arm attaching means of an embodiment of the present invention.

FIG. 10 is a front view of an alternative weight arm attaching means also showing with phantom lines the adjustment position of an embodiment of the present invention.

FIG. 11 is a plan view of an alternative weight arm attaching means of an embodiment of the present invention.

DETAILED DESCRIPTION OF THE PREFERRED EMBODIMENT

Referring to FIG. 1 the exercise device comprises a stand 10, with a pivot bracket 12 attached to the top of the stand for retaining a pivot plate 14 that is pivotable about a horizontal axis A. The pivot plate is fitted with a foot receiving means 16 that is adjustable about a vertical axis B to change the orientation of the foot receiving means relative to horizontal axis A. An arm 18 extends from the pivot plate perpendicular to both axis A and axis B, for retaining a weight 20 for opposing rotation about horizontal axis A.

As shown in FIGS. 4 and 5, stand 10 includes a base 22 and an adjustable vertical support member 24. The base 22 is cruciform in configuration and made of heavy metal on the order of 1"×1" in cross section. A plurality of feet 26, made of rubber or some other non-skid material, are attached to the underside of the base. A lower swivel plate 28 having a central hole 30 and four anchoring holes 32 drilled equidistant from the central hole and angularly spaced at 90° about said central hole is centered on and welded to base 22. An upper swivel plate 34 having a central pivot hole 36 and adjustment hole 38 lies on top of lower swivel plate 28. Base pivot bolt 40 passes through central pivot hole 36 and central hole 30 to pivotally connect upper swivel plate 34 to lower swivel plate 28, said pivot bolt being secured by washer and nut means generally indicated at 39. Adjustment hole 38 is disposed for alignment with any of said anchoring holes 32 in lower swivel plate 28 so that an alignment bolt 41 passes through adjustment hole 38 in upper swivel plate 34 and extends alternatively into one of the anchoring holes. Thus, assembled the device may be rotated about the base and anchored at any desired angular position corresponding to the location of anchoring holes 32. This rotatable base offers flexibility in the general orientation of the device to the user, an equivalent effect may be obtained by the use of a non-rotatable base that could be lifted and turned.

Vertical support member 24 comprises a height adjustment tube 42, a support rod 44 and a pin 46. Height adjustment tube 42, preferably on the order of from six to nine inches in length having an inside diameter large enough to provide clearance for the disposition of pivot bolt 40 at the bottom end thereof, is welded to the center of upper swivel plate 34. A pin receiving hole 48 is drilled horizontally through the top portion of the height adjustment tube. Support rod 44 has a diameter such that it may slide into height adjustment tube 42, said support rod has a plurality of height adjustment holes 50 in a vertically spaced relationship. The height of the vertical support member 24 is adjusted by inserting pin 46 through pin receiving hole 48 and the desired height adjustment hole 50.

Pivot bracket 12, as shown in FIG. 4, comprises crossbar 52, first and second arms 54 and 56 extending vertically upward from said crossbar and first and second bearings 58 and 60 are disposed in the upper ends of said arms. Crossbar 52 is welded in the middle of the bottom surface to the upper end of support rod 44. First and second bearings are disposed on horizontal axis A so that a flat, rectangular pivot plate 14 is pivotally held between arms 54 and 56 by means of first and second rods 62 and 64 which are welded to the underside of pivot plate 14 projecting from opposite edges thereof and through bearing 58 and 60. First and second rods may be formed with flat tangential portions where they contact the pivot plate to facilitate welding. Assembly of pivot plate 14 and pivot bracket 12 is accomplished by welding first arm 54 to crossbar 52, subsequently first rod 62 is inserted into first bearing 58 and then secured at the opposite end by fastening second arm 56 with machine screws 65 to crossbar 52 so that second rod 64 is journaled within second bearing 60. A swivel hole 66 is drilled through the center of pivot plate 14 and is surrounded by four holes 68 which are arranged in a square centered on the swivel hole, as shown in FIG. 2.

FIG. 6 is a detailed drawing of the foot receiving means generally indicated at 16 in FIG. 1. Foot plate 70 is an oblong, roughly foot-sized plate of steel, preferably with rounded ends, and is formed with slots 72 running along both sides to receive foot retaining straps 74 which pass therethrough as shown. Buckles 76 are provided to allow tightening of straps 74 to hold the sole of the user's foot firmly against foot plate 70. At one end of the foot plate are two heel pieces 78, projecting perpendicularly upward therefrom approximately one inch to one and one half inches. Heel pieces 78 are spaced around the curved heel end of foot plate 70 in order to cup and position the user's foot on said foot plate.

As shown in FIG. 4, spacer plate 80 abuts and is welded to or formed integrally with the foot plate. A swivel bolt 82 is welded to the underside of the spacer plate 80 and passes through swivel hole 66 in pivot plate 14 to pivotally mount foot receiving means 16 on pivot plate 14. A lock washer and nut combination 84 on swivel bolt 82 secures the assembly.

As shown in FIGS. 2, 4, and 6, tongue 86 extends laterally from spacer plate 80 beyond the edge of foot plate 42. A locking hole 88, of the same diameter as holes 68 in pivot plate 14, passes through tongue 86 and is disposed so that locking hole 88 can be aligned alternatively with each of the four holes 68 in pivot plate 14. A locking pin 90 is inserted through locking holes 88 and into one of holes 68 to secure foot receiving means 16 in the desired position relative to the pivot axis A.

By aligning the length of the foot retention means 16 parallel to pivot axis A, as shown in FIG. 6, exercises involving inversion or eversion of the ankle may be performed. Locking pin 90 may then be removed to allow foot receiving means 16 to be rotated about axis B as shown by phantom lines in FIG. 6, to a position perpendicular to pivot axis A, as shown in FIG. 2, locking pin 90 is then reinserted to allow dorsiflexion and plantarflexion of the ankle.

As shown in FIGS. 7 and 8, arm 18 is welded to pivot plate 14 so that it extends laterally from the pivot plate in a direction perpendicular to pivot axis A. Arm 18 has a series of holes 92 bored into its upper surface, spaced approximately one inch apart. A weight holer 94 is a rod shape member having a disk shaped flange 96 spaced approximately one inch from its lower end, said weightholder being insertable into any one of the holes 92. To prepare the device for use, weight holder 94 is placed into one of said holes 92 that is the desired distance from the pivot axis, then disc-shaped weights 20 as shown in FIGS. 1 and 3, such as those available from most exercise equipment manufacturers, are stacked on the weight holder 94 to obtain the desired resistance to rotation of the pivot plate about axis A.

FIGS. 9 through 11 depict several alternative embodiments for adjustably attaching the weights 20 to the pivot plate 14. In FIGS. 9 and 10 weight arm 100 and weight holding rod 102 are a single welded unit, with holes 104 drilled in the upper side of weight arm 100. Two weight arm receiving plates 106 are aligned parallel to each other and are attached to the bottom surface of pivot plate 14. The plates are spaced to allow weight arm 100 to pass between them, and are joined at their bottom outside corner by a connecting pin 108. The weight arm receiving plates 106 are positioned to one side of the swivel bolt 82 so as to not interfere with said swivel bolt. A stud 110 projects downward from the underside of pivot plate 14 between weight arm receiving plates 106 in a position such that it will engage one of the holes 104 when weight arm 100 is inserted horizontally between the weight arm receiving plates as shown in FIG. 10. The effective length of weight arm 100 is changed by lifting upward on the weight holding rod so as to tilt the weight arm thereby disengaging stud 110 from one of the holes 64, then sliding weight arm 62 toward or away from axis A. The weight arm is anchored by engaging the stud 110 with another hole 64 as previously discribed.

An additional weight arm arrangement is shown in FIG. 11. In this embodiment, a tube 112 of square section is welded to the underside of pivot plate 14 and slidably receives weight arm 114. A plurality of holes 116 are drilled through weight arm 114 and a hole 118 is drilled through tube 112 where it projects from the pivot plate so that a pin 120 is inserted through hole 118 into one of the holes 116 to set the weight arm at the desired length.

Further embodiment not shown but amenable to any of the above weight arm arrangements would be to add a second arm or arm retaining means to the opposite side of the pivot plate, from the first weight arm. The weight is thus transferable to the opposite side of the pivot plate without having to rotate the foot receiving means 180°. This arrangement would allow a complete series of four exercises; anterior flexion, posterior flexion, lateral flexion to the right and to the left, to be performed with a single 90° rotation of the foot receiving means 40.

In the preceding detailed description, certain specific dimensions and terminology were used for the sake of clarity and particular embodiments were described in accordance with the requirements of 35 USC 112, but it is to be understood that the foregoing description is not to be construed in a limiting sense.

The embodiments of the invention in which an exclusive property or privilege is claimed are defined as follows:

1. In an ankle exercising apparatus of the type having a stand, a pivot plate pivotably connected to the stand for rotation about a horizontal axis, and a rotation resisting means attached to the pivot plate, the improvement comprising:

a foot receiving means pivotably mounted on the plate for selective rotation about a vertical axis between at least a first position relative to the rotation resisting means in which the ankle is exercised about one axis of possible ankle movement and a second position approximately at right angles to the first position relative to the rotation resisting means in which the ankle is exercised about another axis of possible ankle movement;

means for locking the foot receiving means at each of said first and second positions relative to the pivot plate for use in the selected position;

said rotation resisting means comprising a weight arm having a vertical pin stationed thereon and extending upwardly therefrom in spaced relation to the pivot plate for receiving angular weights thereon;

and means for adjusting the distance between the pivot plate and the vertical pin.

2. The exercising apparatus of claim 1 in which said weight arm is formed with a plurality of holes along the length of its upper side, said vertical pin removably fitting into any of said holes in order to retain weights at a desired position on said weight arm.

3. The exercising apparatus of claim 1 in which said weight arm is attached to said pivot plate by means of:

two rectangular plates extending perpendicularly from the underside of said pivot plate in spaced relationship, with their major axis being perpendicular to said pivot axis;

a connecting pin extending perpendicularly between said rectangular plates at the lower edge thereof; and a stud extending perpendicularly from the underside of said pivot plate between said rectangular plates;

whereby said weight arm, further having a series of holes passing through its upper side, can be received between said rectangular plates and be supported on its underside by said connecting pin and on its upper side by said pivot plate, with said stud engaging any one of said holes in said weight arm.

4. The exercise apparatus of claim 1 in which said weight arm is attached to said pivot plate by means of:

a tube of square cross-section attached to the underside of said pivot plate and extending beyond the edge thereof, its center axis parallel to said pivot plate and perpendicular to said horizontal pivot axis, with a pin receiving hole passing through the portion of said tube ending beyond the edge of said pivot plate;

a weight arm having a plurality of spaced holes passing therethrough; and a pin insertable through the pin receiving hole in the tube and one of the spaced holes in the weight arm;

whereby said pin adjustably secures said weight arm in said tube.

5. Ankle exercising apparatus as defined in claim 1 and further including means for adjusting the height of said stand.

* * * * *